US009573262B2

(12) United States Patent
Takeuchi et al.

(10) Patent No.: US 9,573,262 B2
(45) Date of Patent: Feb. 21, 2017

(54) IMPACT TOOL

(71) Applicant: MAKITA CORPORATION, Anjo-shi, Aichi (JP)

(72) Inventors: Hajime Takeuchi, Anjo (JP); Masanori Furusawa, Anjo (JP); Yoshiro Tada, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 596 days.

(21) Appl. No.: 14/055,370

(22) Filed: Oct. 16, 2013

(65) Prior Publication Data

US 2014/0138112 A1 May 22, 2014

(30) Foreign Application Priority Data

Nov. 19, 2012 (JP) ..... 2012-253590
Nov. 19, 2012 (JP) ..... 2012-253591

(51) Int. Cl.

| | |
|---|---|
| ***B25D 7/00*** | (2006.01) |
| ***B25D 17/00*** | (2006.01) |
| ***B25D 16/00*** | (2006.01) |
| ***B25D 17/06*** | (2006.01) |

(52) U.S. Cl.

CPC ..... *B25D 17/00* (2013.01); *B25D 16/00* (2013.01); *B25D 17/06* (2013.01); *B25D 2211/003* (2013.01); *B25D 2211/068* (2013.01); *B25D 2217/0019* (2013.01); *B25D 2250/121* (2013.01); *B25D 2250/245* (2013.01)

(58) Field of Classification Search

CPC ..... B25D 17/00
USPC ..... 173/48, 117, 122, 201, 210, 211
See application file for complete search history.

(56) References Cited

U.S. PATENT DOCUMENTS 3,847,229 A * 11/1974 Wanner ..... B25D 16/00 173/110
3,921,729 A 11/1975 Schmuck
4,192,391 A 3/1980 Kastreuz et al.
4,236,588 A * 12/1980 Moldan ..... B25D 16/006 173/201

(Continued)

FOREIGN PATENT DOCUMENTS

CN 101306529 A 11/2008
EP 2 199 028 A2 6/2010

(Continued)

OTHER PUBLICATIONS

Extended Search Report issued in European Patent Application No. 13191983.9 mailed Feb. 19, 2014.

(Continued)

*Primary Examiner* — Nathaniel Chukwurah
(74) *Attorney, Agent, or Firm* — Oliff PLC

(57) ABSTRACT

A hammer drill serving as an impact tool is provided with a crank housing that accommodates a crankshaft, and a cylinder accommodated in the crank housing. Receiving portions that receive the cylinder which is pressed rearward are provided at multiple locations of the crank housing in the front-rear direction. At least one of the receiving portions is disposed to receive the rear-end portion of the cylinder. A portion of the cylinder, which is received by another one of the receiving portions is a circlip (circumferential member) made of a metal.

9 Claims, 6 Drawing Sheets

(56) References Cited

U.S. PATENT DOCUMENTS

| | | | | |
|---|---|---|---|---|
| 4,763,733 | A * | 8/1988 | Neumaier | B25D 16/006 173/109 |
| 7,647,985 | B2 * | 1/2010 | Furusawa | B25D 16/006 173/117 |
| 2004/0194987 | A1 | 10/2004 | Hanke et al. | |
| 2005/0145403 | A1 | 7/2005 | Kikuchi | |
| 2007/0209815 | A1 * | 9/2007 | Iwakami | B25D 16/006 173/48 |

FOREIGN PATENT DOCUMENTS

| | | | |
|---|---|---|---|
| JP | S56-157978 | A | 12/1981 |
| JP | S62-107985 | A | 5/1987 |
| JP | H06-137389 | A | 5/1994 |
| JP | 2002-283254 | A | 10/2002 |
| JP | 2004-066439 | A | 3/2004 |
| JP | A-2006-136972 | | 6/2006 |
| JP | 2008-207587 | A | 9/2008 |
| JP | A-2008-279587 | | 11/2008 |
| JP | 2009-208208 | A | 9/2009 |

OTHER PUBLICATIONS

Apr. 3, 2015 Office Action issued in Chinese Application No. 201310574498.8.

Mar. 15, 2016 Office Action issued in Japanese Patent Application No. 2012-253590.

Mar. 15, 2016 Office Action issued in Japanese Patent Application No. 2012-253591.

* cited by examiner

IMPACT TOOL

BACKGROUND OF THE INVENTION

This application claims the benefit of Japanese Patent Application Number 2012-253590 filed on Nov. 19, 2012 and Japanese Patent Application Number 2012-253591 filed on Nov. 19, 2012, the entirety of which is incorporated by reference.

TECHNICAL FIELD

The present invention relates to an impact tool that applies a hammering action to a workpiece.

BACKGROUND ART

Japanese Patent Application Publication No. 2008-279587 (JP 2008-279587 A) describes an electric hammer including a striker that causes a hammer bit to apply a hammering action and a cylinder that accommodates a piston.

In such an electric hammer, the cylinder is inserted from the front into a cylindrical-shaped cylinder holding portion formed in the front region of a gear housing, and the inserted end of the cylinder contacts an end surface which is formed in the cylinder holding portion in a direction intersecting the direction of insertion of the cylinder. By this contact, the rear end position of the cylinder is defined so that the cylinder is fixed (see paragraph [0016], FIG. 5, etc. of JP 2008-279587 A).

Japanese Patent Application Publication No. 2006-136972 (JP 2006-136972 A) describes a hammer drill including a tool holder to which a bit is mountable.

An impact bolt that causes the bit to apply a hammering action and the front portion of a cylinder that accommodates a striker that moves the impact bolt and a piston that moves the striker are inserted into the tool holder.

A bevel gear is disposed on the rear-end side of the tool holder. The bevel gear is rotatable around the cylinder upon receiving a drive force from an intermediate shaft. The bevel gear is fixed to the rear-end portion of the tool holder to rotate the tool holder. Rotation of the tool holder rotates the bit etc., achieving a drilling action.

In such a hammer drill, the bevel gear is positioned (restrained from moving in the front-rear direction which corresponds to the rotational axis direction) by a gear housing (barrel) via a cushioning member as appropriate.

SUMMARY OF THE INVENTION

In the electric hammer according to JP 2008-279587 A, only the rear portion of the cylinder is supported by the gear housing. In particular, the cylinder is supported only at one location, that is, at the inserted end portion, in a direction intersecting the direction of the hammering action.

Thus, a stress and a reaction force caused by the hammering action transferred to the cylinder are applied to only the rear-end surface of the cylinder which is thin or the end surface of the cylinder holding portion, causing concentration of the load at a specific location. This may require consideration in design, and may limit improvement in rigidity and durability for fixation of the cylinder.

It is therefore a main object of the present invention to provide an impact tool in which a cylinder can be fixed with high rigidity and durability.

In the hammer drill according to JP 2006-136972 A, movement of the bevel gear in the front-rear direction is restrained by the gear housing. Therefore, if the tool holder is displaced in the front-rear direction even slightly upon receiving a striking reaction force or the like, the bevel gear is also displaced in the front-rear direction to move relative to the intermediate shaft. This may cause misalignment between the bevel gear and the intermediate shaft which are meshed with each other, resulting in temporarily deteriorating operation. Frequent occurrence of such misalignment may cause wear of the bevel gear and the intermediate shaft, for example, and consequently affecting the life.

It is therefore a main object of the present invention to provide an impact tool including a bevel gear etc. that operates well and has an extended life.

In order to achieve the foregoing object, a first aspect of the present invention provides an impact tool including a crank housing that accommodates a crank and a cylinder that is accommodated in the crank housing. Receiving portions that receive the cylinder which is pressed rearward are provided at multiple locations of the crank housing in a front-rear direction.

A second aspect of the present invention provides the impact tool according to the aspect described above, in which at least one of the receiving portions is disposed so as to receive a rear-end portion of the cylinder.

A third aspect of the present invention provides the impact tool according to the aspect described above, in which at least one portion, among portions of the cylinder which are received by the receiving portions, is a circumferential member made of a metal.

A fourth aspect of the present invention provides the impact tool according to the aspect described above, in which the crank housing is made of a magnesium alloy.

A fifth aspect of the present invention provides the impact tool according to the aspect described above, in which a corner portion of at least one receiving portion among the receiving portions is rounded, and a corner portion of the cylinder corresponding to the corner portion of the at least one receiving portion has an escape portion provided apart from the corner portion of the at least one receiving portion.

In order to achieve the foregoing object, in addition, a sixth aspect of the present invention provides the impact tool according to the aspect described above, further including a tool holder to which a bit is mountable, a bevel gear that rotates the tool holder, a sleeve member disposed adjacent to the bevel gear, and a barrel disposed adjacent to the crank housing. The sleeve member is held between the crank housing and the barrel to be fixed in an axial direction of the tool holder.

A seventh aspect of the present invention provides the impact tool according to the aspect described above, in which the sleeve member includes a flange held between the crank housing and the barrel, and a rear-end portion of the sleeve member is provided adjacent to a front side of the bevel gear.

An eighth aspect of the present invention provides the impact tool according to the aspect described above, in which the sleeve member is formed by pressing.

A ninth aspect of the present invention provides the impact tool according to the aspect described above, in which the sleeve member includes a projection, and the crank housing is provided with a recessed portion that receives the projection.

A tenth aspect of the present invention provides the impact tool according to the aspect described above, further including a cam member that is engageable with the bevel gear. An outside diameter of the cam member is substantially the same as an inside diameter of the sleeve member.

An eleventh aspect of the present invention provides the impact tool according to the aspect described above, in which the cam member includes a groove provided circumferentially. The groove is engaged with a slide plate that switchably establishes and releases engagement of the cam member with the bevel gear, and the sleeve member is provided with a notched portion to avoid the slide plate.

According to the first aspect of the present invention, among the aspects of the present invention, the receiving portions which receive the cylinder which is pressed rearward are provided at multiple locations of the crank housing in the front-rear direction. Thus, the cylinder can be reliably received. This allows the load on the receiving portions to be reduced and occurrence of a crack to be prevented, for example. Thus, the durability can be improved and the life of the impact tool can be extended.

According to the second aspect of the present invention, at least one of the receiving portions is disposed so as to receive the rear-end portion of the cylinder. Thus, in addition to the effect described above, the receiving portion is capable of receiving the entire cylinder against a rearward force.

According to the third aspect of the present invention, the at least one portion, among the portions of the cylinder which are received by the receiving portions, is a circumferential member made of a metal. Thus, in addition to the effect described above, the circumferential member can be firmly received by the receiving portion without being significantly deflected.

According to the fourth aspect of the present invention, the crank housing is made of a magnesium alloy. Therefore, in addition to the effect described above, the crank housing which accommodates the cylinder can be made lightweight and highly rigid, allowing the cylinder to be received further reliably.

According to the fifth aspect of the present invention, the corner portion of the at least one receiving portion among the receiving portions is rounded, and the corner portion of the cylinder corresponding to the corner portion of the at least one receiving portion has the escape portion provided apart from the corner portion of the at least one receiving portion. Therefore, in addition to the effect described above, concentration of a stress at the corner portion can be avoided. This allows the cylinder to be received reliably, further improving the durability of the receiving portion and extending the life of the receiving portion.

According to the sixth aspect of the present invention, among the aspects of the present invention, in addition, the sleeve member which is disposed adjacent to the bevel gear is held between the crank housing and the barrel to be fixed in the axial direction of the tool holder. Therefore, movement of the bevel gear in the front-rear direction can be reliably prevented. This allows the bevel gear and members around the bevel gear to operate well, preventing wear of such components to extend the life thereof. The bevel gear can be temporarily retained, facilitating accurate assembly of the bevel gear.

According to the seventh aspect of the present invention, the sleeve member includes the flange held between the crank housing and the barrel, and the rear-end portion of the sleeve member is provided adjacent to the front side of the bevel gear. Thus, in addition to the effect described above, movement of the bevel gear in the front-rear direction can be suppressed appropriately in the case where the bevel gear is disposed inside the crank housing. Since the flange is formed at the front-end portion of the sleeve member, the bevel gear can be temporarily retained appropriately.

According to the eighth aspect of the present invention, the sleeve member is formed by pressing. Thus, in addition to the effect described above, the sleeve member can be hardened, appropriately suppressing movement of the bevel gear in the front-rear direction.

According to the ninth aspect of the present invention, the sleeve member includes the projection, and the crank housing which accommodates the sleeve member is provided with the recessed portion which receives the projection. Therefore, the sleeve member is prevented from rotating together with the bevel gear and the cam member, securing accurate operation even if the sleeve member is provided.

According to the tenth aspect of the present invention, the impact tool further includes the cam member which is engageable with the bevel gear. The outside diameter of the cam member is substantially the same as the inside diameter of the sleeve member (the outside diameter of the cam member is slightly smaller than the inside diameter of the sleeve member). Therefore, in addition to the effect described above, the cam member configured to switch whether or not to rotate the tool holder can operate even if the sleeve member is provided, allowing the cam member and the bevel gear to be temporarily assembled appropriately.

According to the eleventh aspect of the present invention, the cam member includes the groove provided circumferentially. The groove is engaged with the slide plate which moves in the front-rear direction to switchably establish and release engagement of the cam member with the bevel gear. The sleeve member is provided with the notched portion to avoid the slide plate. Therefore, in addition to the effect described above, the cam member can be engaged with and disengaged from the bevel gear further smoothly even if the sleeve member is provided.

DETAILED DESCRIPTION OF THE EMBODIMENTS

An embodiment and a modification of the present invention will be described below with reference to the drawings as appropriate.

Figures 1A, 1B:
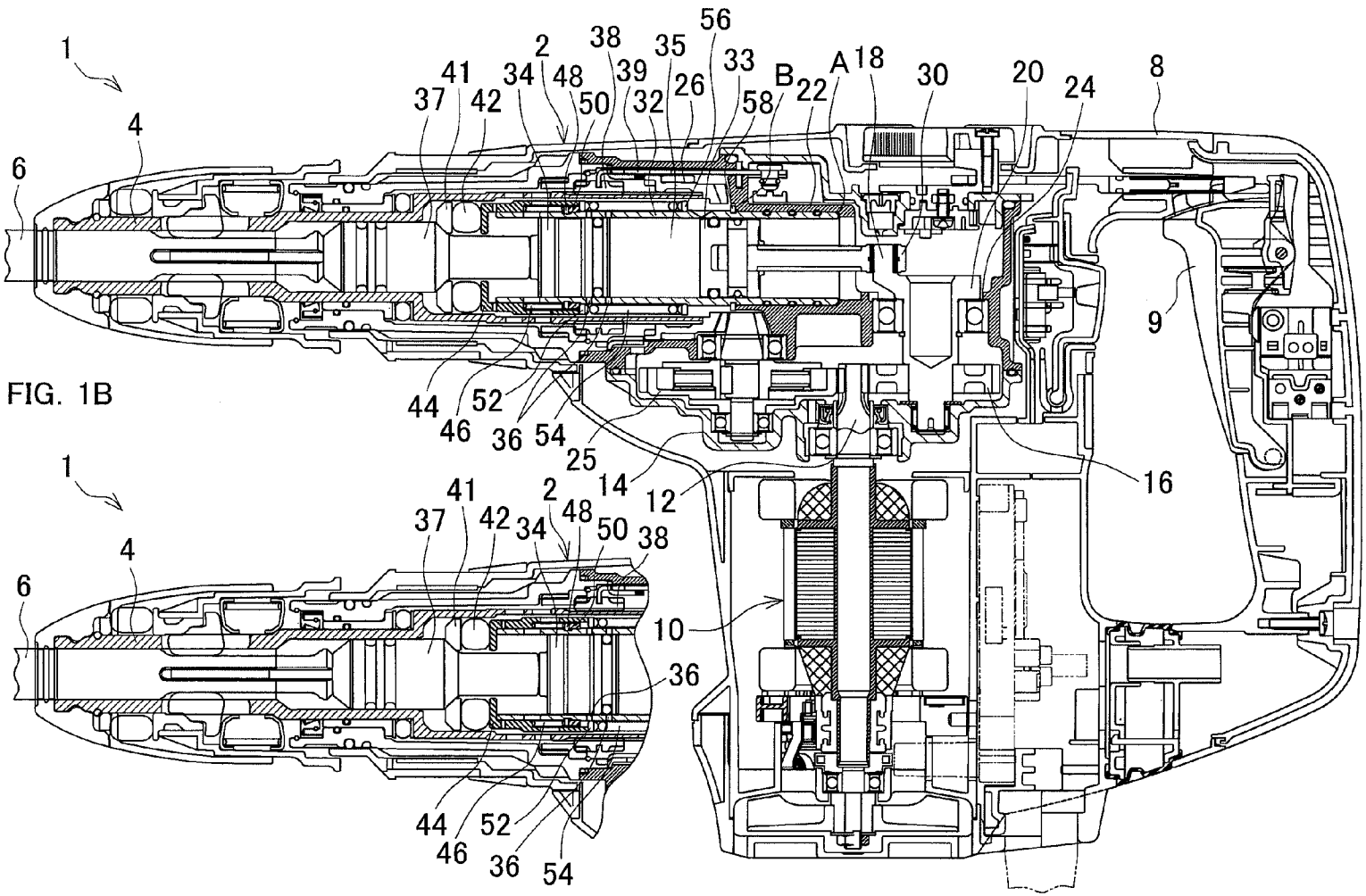
FIG. 1A is a center vertical sectional view of a hammer drill according to the present invention.
FIG. 1B illustrates a distal-end portion of the hammer drill of FIG. 1 with a bit in the maximally retracted state.
Figure 2:
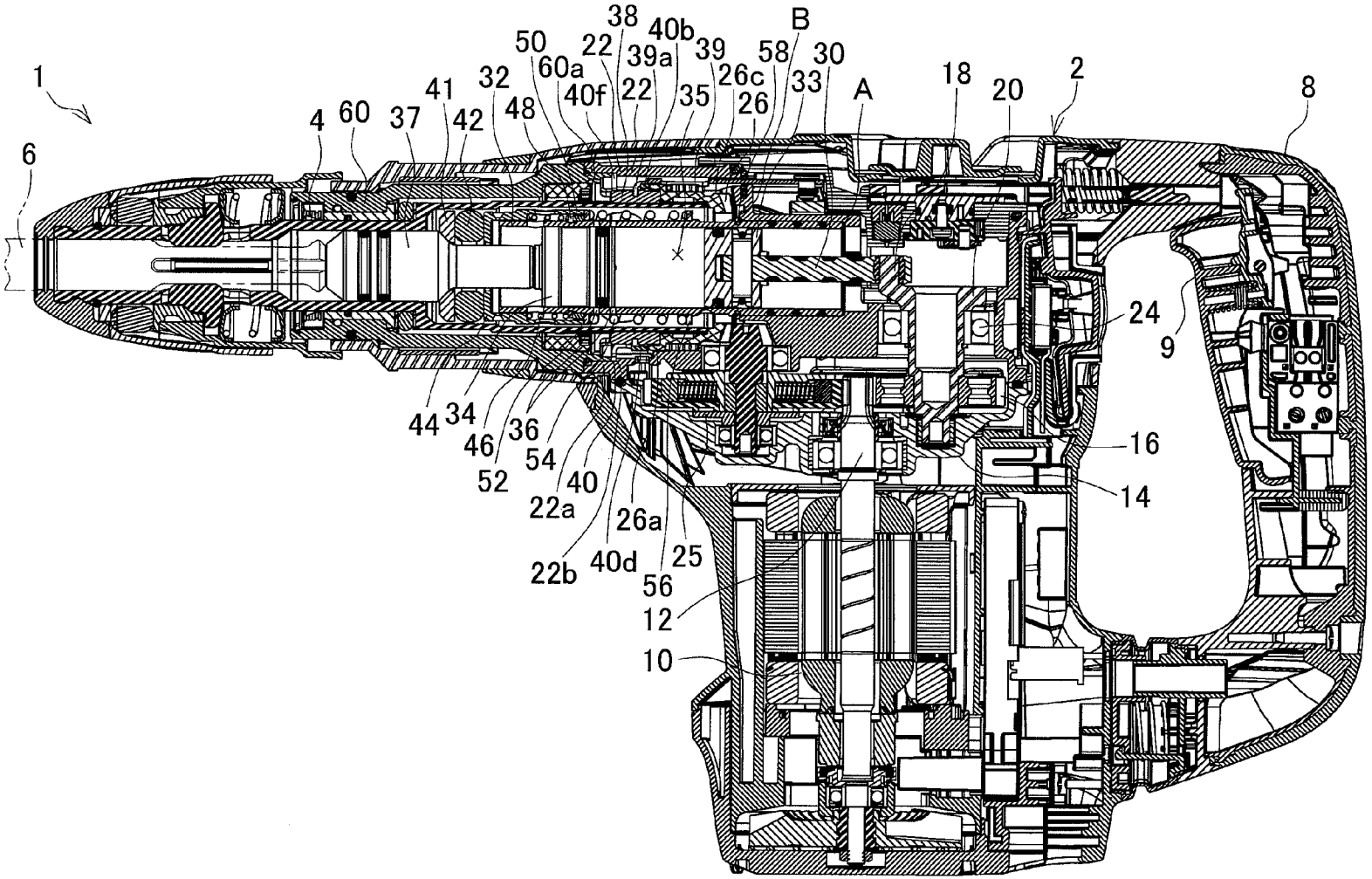
FIG. 2 is a center vertical sectional view of the hammer drill according to the present invention.
Figure 3:
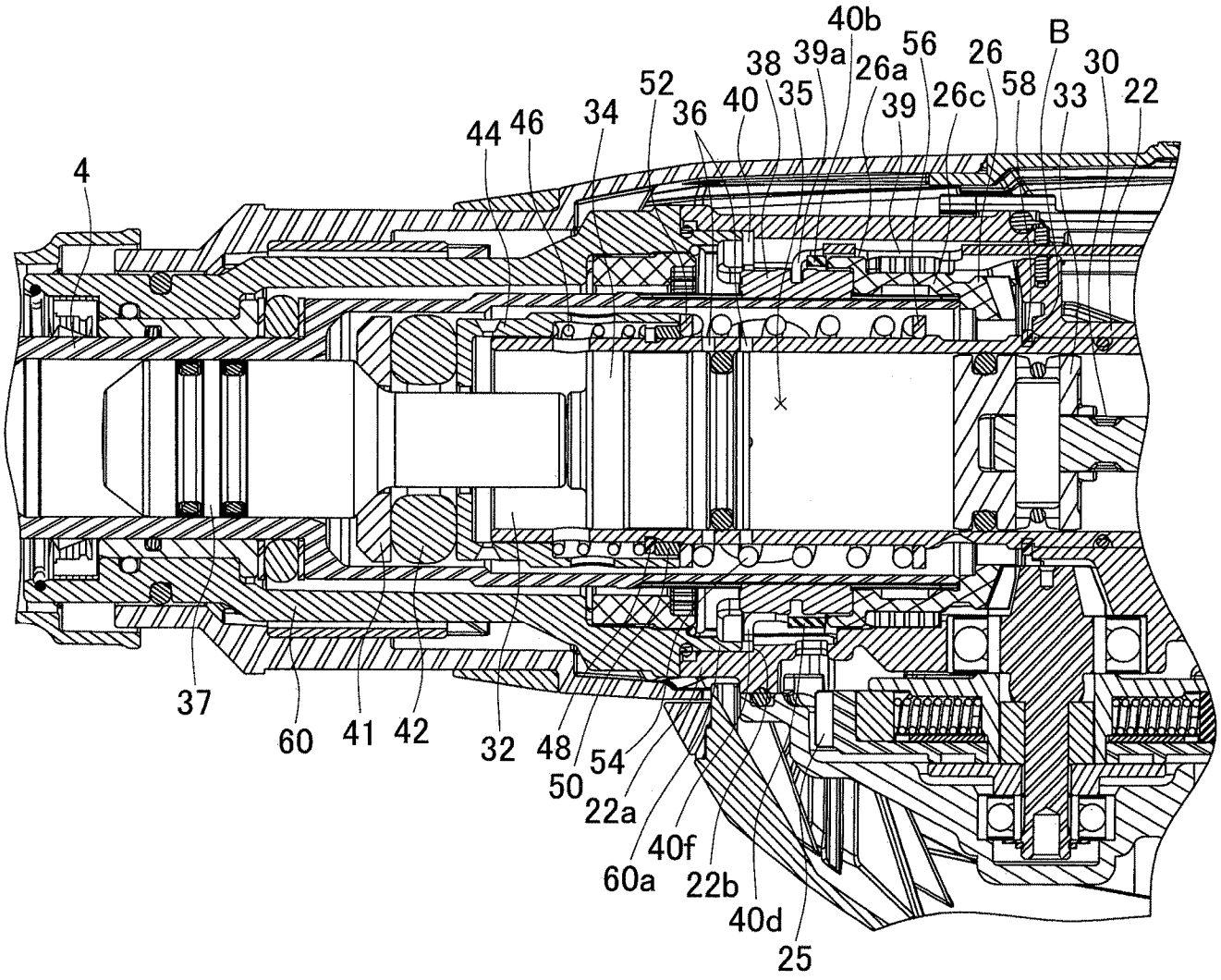
FIG. 3 is an enlarged view of a center portion of FIG. 2.

FIGS. 1A and 2 are each a vertical sectional view of a hammer drill 1 serving as an example of an impact tool. FIG. 3 is an enlarged view of a center portion of FIG. 1.

The hammer drill 1 includes a body housing 2, a bit 6, and a hand grip 8. The body housing 2 forms an outer shell of the hammer drill 1. The bit 6 is removably attached at the front-end region (left side in FIG. 1A) of the body housing 2 via a tool holder 4. The hand grip 8 is formed on the opposite side, or at the rear portion, of the body housing 2 to be grasped by an operator.

The hand grip 8 is provided with a switch lever 9 that can be pressed rearward.

A motor 10 is accommodated in the lower portion of the body housing 2. A motor rotary shaft 12 is inserted into the lower portion of a gear housing 14 fixed at the center of the upper portion of the body housing 2.

A horizontal driven gear 16 is meshed with the upper portion, which is the distal-end portion, of the motor rotary shaft 12. The driven gear 16 is fixed around the lower portion of a crankshaft 20 having a crank projection 18 provided on the periphery of the upper-end portion. The crankshaft 20 serving as a crank is attached in the gear housing 14 so as to be rotatable about a rotational axis extending in the up-down direction. A crank housing 22 made of a magnesium alloy is fixed in the gear housing 14. The front portion of the crank housing 22 has a tubular shape with its axis extending in the front-rear direction. The rear portion of the crank housing 22 has a tubular shape with its axis extending in the up-down direction. The upper portion of the crankshaft 20 is arranged in the rear tubular portion of the crank housing 22. The crankshaft 20 is rotatably supported at a portion thereof by a crank bearing 24 in the rear tubular portion of the crank housing 22.

An intermediate shaft unit 25 is disposed on the opposite side (front side) of the motor rotary shaft 12 from the driven gear 16. The intermediate shaft unit 25 is rotatably supported between the gear housing 14 and the crank housing 22. The intermediate shaft unit 25 is meshed with the motor rotary shaft 12 and a bevel gear 26 to be discussed later.

The crank projection 18 of the crankshaft 20 is rotatably inserted into a hole that opens in the rear portion of a rod 30 extending in the front-rear direction.

The rear portion of a cylinder 32 with its axis extending in the front-rear direction is inserted into the front tubular portion of the crank housing 22. The front portion of the rod 30 is positioned in the cylinder 32.

The rear-end portion of the cylinder 32 is received by a receiving portion A formed on the inner wall of the crank housing 22 extending along the up-down direction. The inner wall is formed between the front tubular portion and the rear tubular portion of the crank housing 22.

Figure 4:
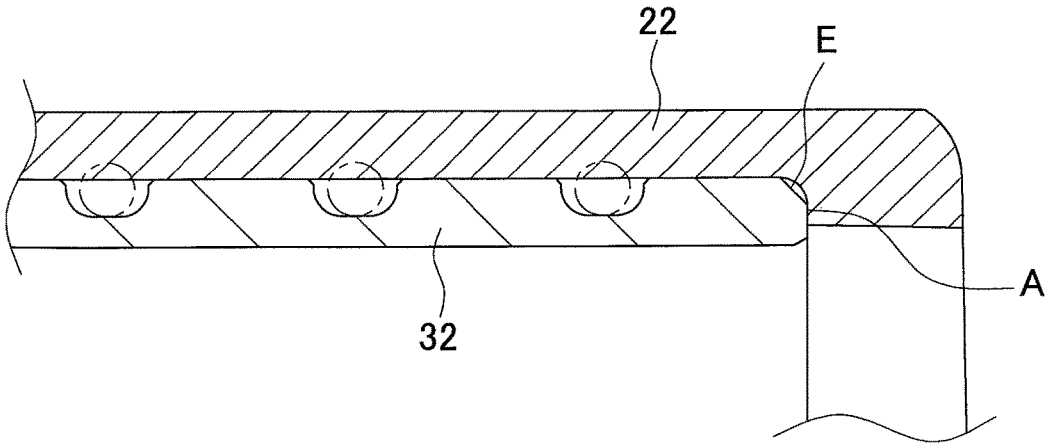
FIG. 4 is an enlarged view illustrating the vicinity of a receiving portion A of FIGS. 1 and 2.

The receiving portion A and the outer peripheral edge at the rear end of the cylinder 32 are rounded. More particularly, as illustrated in FIG. 4, the corner portion of the receiving portion A is formed to be rounded (by filling a sharp corner, for example), and the corner portion (outer peripheral edge at the rear end) of the cylinder 32 is chamfered. The chamfered surface of the corner portion of the cylinder 32, the rear end of which is positioned at the receiving portion A, is located apart from the rounded corner portion of the receiving portion A. Thus, the chamfered corner portion of the cylinder 32 has an escape portion E with respect to the corner portion of the receiving portion A.

A column-shaped piston 33 is coaxially inserted into the cylinder 32 so as to be slidable in an air-tight state. The outside diameter of the piston 33 is substantially the same as the inside diameter of the cylinder 32. The front-end portion of the rod 30 is connected to the rear portion of the piston 33.

A striker 34 is accommodated in the cylinder 32 and in front of the piston 33 so as to be slidable in an air-tight state as with the piston 33.

An air chamber 35 is provided between the piston 33 and the striker 34.

Ventilation holes 36 are formed to open in the upper and lower portions of the front portion of the cylinder 32.

An impact bolt 37 in the form of a bar with a swelled head portion (front portion) is fixed to the front portion of the striker 34. The base end (rear end) of the mounted bit 6 is positioned on the front side of the impact bolt 37.

The tool holder 4 extends so as to surround the base portion of the bit 6, the impact bolt 37, and the front portion of the cylinder 32. The rear portion of the tool holder 4 is increased in diameter, both inside and outside diameters, with respect to the front portion of the tool holder 4 which accommodates the base portion of the bit 6 and the head portion of the impact bolt 37.

A part of the rear portion of the tool holder 4, which is increased in diameter, is inserted into the front portion of the crank housing 22. The rear-end portion of the tool holder 4 is inserted into the bevel gear 26 in a cylindrical shape with its axis extending in the front-rear direction. The bevel gear 26 accommodates the rear-end portion of the tool holder 4 in the crank housing 22, and is rotatable by the intermediate shaft unit 25 around and on the rear side of the tool holder 4.

Figure 5:
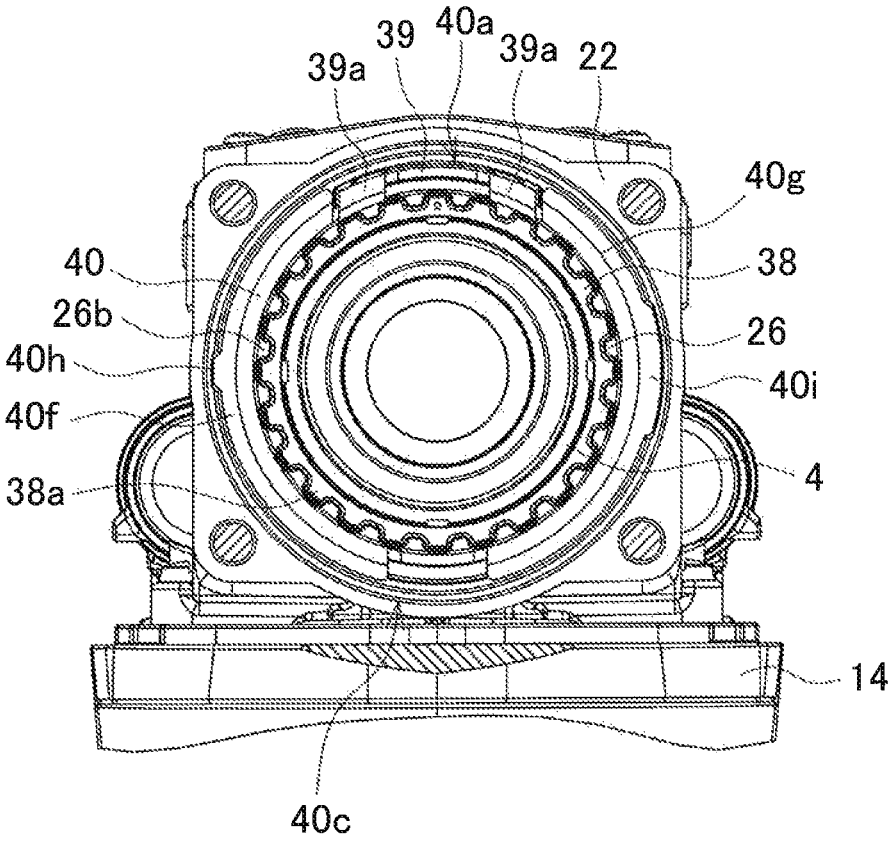
FIG. 5 is a front view of a crank housing and members around the crank housing of FIG. 2.
Figure 6:
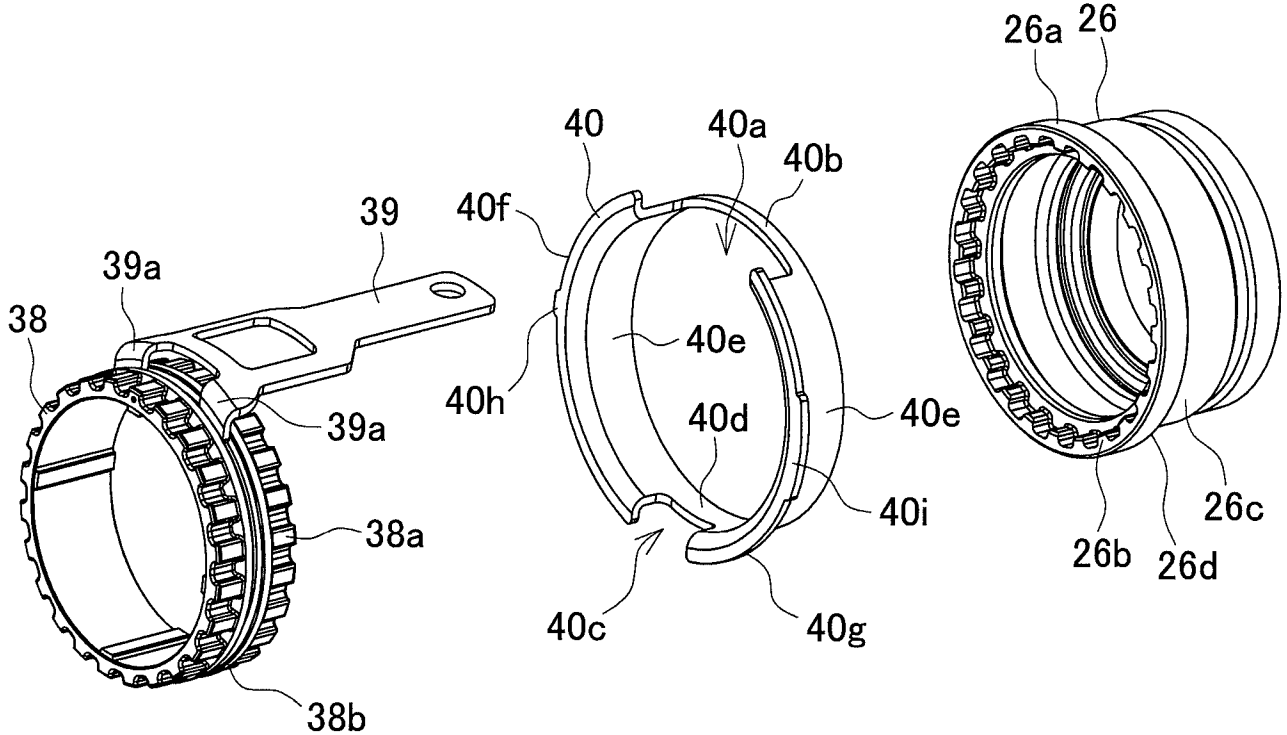
FIG. 6 is a partially exploded perspective view of the crank housing and the members around the crank housing of FIG. 2.

As also illustrated in FIGS. 5 and 6, a spline ring 38 serving as a cam member is attached to the front side of the bevel gear 26. The spline ring 38 is movable in the front-rear direction on the outer wall of the tool holder 4 and is rotatable together with the tool holder 4 at any position in the front-rear direction within the movable range. The spline ring 38 is connected to a slide plate 39 extending along the front-rear direction. In the state in which the slide plate 39 is located on the front side (the state of FIG. 1A), the spline ring 38 is disengaged from the bevel gear 26 so that rotation of the bevel gear 26 caused by the motor 10 or the intermediate shaft unit 25 is not transferred to the spline ring 38 or the tool holder 4. In the case where the slide plate 39 is pulled rearward from the state of FIG. 1A by an operation portion (not illustrated) (the state of FIGS. 2 and 3), on the other hand, the spline ring 38 engages with the bevel gear 26 so that the drive force of the motor 10 is transmitted to the tool holder 4 through the intermediate shaft unit 25, the bevel gear 26, and the spline ring 38.

The spline ring 38 and the bevel gear 26 engage with each other with teeth 38*a*, which are formed on the outer peripheral surface of the spline ring 38, and teeth 26*b*, which are formed on the inner peripheral surface of a front portion 26*a* of the bevel gear 26, meshed with each other.

A groove 38*b* is provided circumferentially on the outer peripheral surface of the spline ring 38 at the center in the front-rear direction. Hooks 39*a* and 39*a* provided at the front portion of the slide plate 39 are fitted in the groove 38*b*. In FIG. 6, only the spline ring 38 and the slide plate 39 are illustrated in the connected state.

A sleeve member 40 formed in a ring shape by pressing is disposed on the outer side of the spline ring 38.

A notched portion 40*a* is provided on the front side of the upper portion of the sleeve member 40 so that only a narrow arc portion 40*b* on the rear side remains. Likewise, a notched portion 40*c* and an arc portion 40*d* are provided at the lower portion of the sleeve member 40. Arc portions 40*e* and 40*e* that are relatively wide are disposed on both sides of the arc portions 40*b* and 40*d* to couple the arc portions 40*b* and 40*d* to each other. A singular ring portion is formed at the rear portion of the sleeve member 40 by the arc portions 40*b*, 40*d*, 40*e*, and 40*e*.

The flanges 40*f* and 40*g* are outwardly formed at the front-end portion of the sleeve member 40 except at the notched portions 40*a* and 40*c*. A small projection 40*h* projecting outwardly is provided at the center portion of the outer periphery of the flange 40*f*. A projection 40*i* projecting outwardly is provided at the center portion of the outer periphery of the flange 40*g*.

A rear portion 26*c* of the bevel gear 26 is a cylindrical portion that is smaller in diameter than the front portion 26*a*. A step 26*d* is formed between the front portion 26*a* and the rear portion 26*c*.

The sleeve member 40 is disposed with its rear portion (the arc portions 40*b*, 40*d*, 40*e*, and 40*e*) located on the front side of the front portion 26*a* (the root of the teeth 26*b*) of the bevel gear 26. In this state, the flanges 40*f* and 40*g* of the sleeve member 40 are placed outside of the front portion of the spline ring 38 which has been moved rearward.

In the case where the slide plate 39 is pulled maximally rearward with the slide plate 39 passing through the notched portion 40*a* of the sleeve member 40 (the state of FIGS. 2 and 3), the hooks 39*a* contact the arc portion 40*b*, and the teeth 38*a* of the spline ring 38 are deeply meshed with the teeth 26*b* of the bevel gear 26.

A ring 41 and a rubber ring 42 with their axes extending in the front-rear direction are disposed on the rear side of the head portion of the impact bolt 37 so as to surround the impact bolt 37.

A tubular slide sleeve 44 that is slidable in the front-rear direction is provided to extend from the rear side of the rubber ring 42 to the periphery of the front-end edge of the cylinder 32.

The front-end portion of the slide sleeve 44 has a ring-shaped wall portion extending along the up-down direction to receive the rubber ring 42. The inside diameter of the front portion of the slide sleeve 44 excluding the front-end portion is substantially the same as the outside diameter of the cylinder 32. The inside diameter of the rear portion of the slide sleeve 44 is increased with respect to that of the front portion.

In the rear portion of the slide sleeve 44 that is increased in diameter, a small spring 46 is accommodated between the inner wall of the slide sleeve 44 and the outer wall of the cylinder 32. The small spring 46 serves as a first elastic element that applies an elastic action in the front-rear direction.

The front end of the small spring 46 contacts a small wall that is provided by increase in the diameter of the rear portion of the slide sleeve 44 and extends along the up-down direction. The rear end of the small spring 46 is retained by a ring-shaped first circlip 48 with its axis extending in the front-rear direction. The first circlip 48 is inserted into a groove (step) provided circumferentially in the outer wall of the cylinder 32 and having a width substantially the same as a front-rear width of the first circlip 48 to be fixed.

A washer 50 made of a metal hardened by a heat treatment is fixed on the rear side of the first circlip 48. The washer 50 is inserted into a groove provided circumferentially in the outer wall of the cylinder 32 and having a width substantially the same as a front-rear width of the washer 50 to be fixed. The rear surface (a surface extending along the up-down direction) of the groove forms a step with respect to the outer wall surface of the cylinder located in the rear. The groove for the first circlip 48 and the groove for the washer 50 are continuous with each other. The respective depths of the grooves are different from each other (the groove for the washer 50 is the shallower).

A slide ring 52 that is slidable in the front-rear direction on the outer wall of the cylinder 32 is provided on the rear side of the washer 50.

A spring 54 is provided circumferentially on the cylinder 32 on the rear side of the slide ring 52. The spring 54 serves as a second elastic element that applies an elastic action in the front-rear direction. A ring 56 is disposed on the rear side of the spring 54. The ring 56 is fixed in the same manner as the first circlip 48.

A second circlip 58 (a circumferential member provided circumferentially on the body of the cylinder 32) made of a metal is provided in the rear of the ring 56. The second circlip 58 is fixed in the same manner as the first circlip 48.

A part of the inner wall of the crank housing 22 extending along the up-down direction contacts the rear side of the second circlip 58. The part of the inner wall forms a receiving portion B that receives the cylinder 32 via the second circlip 58.

The receiving portion B is formed as a stepped portion corresponding to the second circlip 58 by denting the inside portion of the inner wall rearward by a length substantially the same as a front-rear width of the second circlip 58.

The front portion of the front tubular portion of the crank housing 22 is increased in diameter, both inside and outside diameters, with respect to the rear portion of the front tubular portion. The inner wall is a wall extending in the up-down direction and coupling the front portion and the rear portion of the front tubular portion to each other. The rear portion of the cylinder 32 is inserted into the rear portion of the front tubular portion of the crank housing 22. The receiving portion B is disposed at the front end of the rear portion of the front tubular portion of the crank housing 22.

A barrel 60 is provided in the front portion of the body housing 2 and around the center portion of the tool holder 4 to cover the center portion. The barrel 60 is fixed to the body housing 2 at the opening at the front-end portion of the crank housing 22.

The sleeve member 40 is held between the crank housing 22 and the barrel 60 to be fixed so as to be immovable in the front-rear direction (the direction of the rotational axis of the tool holder 4).

More particularly, the sleeve member 40 is fixed as follows. An opening stepped portion 22*b* is provided in a front-end opening portion 22*a* of the crank housing 22. The opening stepped portion 22*b* is formed by reducing the diameter on the rear side with respect to the diameter on the front side to serve as a step with respect to the front side. A reduced-diameter portion 60*a* is provided at the rear-end portion of the barrel 60. The reduced-diameter portion 60*a* has a diameter slightly reduced so as to be insertable into the front-end opening portion 22*a* of the crank housing 22. The front side of the reduced-diameter portion 60*a* forms a surface extending along the up-down direction, and is disposed to receive the front-end opening portion 22*a* of the crank housing 22. The flanges 40*f* and 40*g* of the sleeve member 40 are held between the rear-end surface of the reduced-diameter portion 60*a* of the barrel 60 extending along the up-down direction and the opening stepped portion 22*b* of the crank housing 22.

The crank housing 22 is provided with recessed portions (not illustrated) located at positions corresponding to the small projection 40*h* and the projection 40*i*. The recessed portions are similar in shape to the small projection 40*h* and the projection 40*i* so as to receive the small projection 40*h* and the projection 40*i*.

An example of operation of the hammer drill 1 will be described.

When an operator presses the switch lever 9 on the hand grip 8 to turn on the power, the motor 10 is actuated to rotate the motor rotary shaft 12. Rotation of the motor rotary shaft 12 is transferred to the bevel gear 26 through the intermediate shaft unit 25. If the spline ring 38 is not engaged with the bevel gear 26 in accordance with the state of the slide plate 39, the tool holder 4 is not rotated, and the bit 6 etc. inside the tool holder 4 is not rotated. If the spline ring 38 is engaged with the bevel gear 26, on the other hand, the tool holder 4 is rotated via the spline ring 38, and the bit 6 etc. inside the tool holder 4 is also rotated.

Rotation of the motor rotary shaft 12 is also transmitted to the crankshaft 20 via the driven gear 16. The crankshaft 20 and the rod 30 convert the rotational motion into reciprocal motion. The piston 33 at the distal end of the rod 30 reciprocates in the cylinder 32.

The piston 33 advances to press air in the air chamber 35, and retracts to draw air in the air chamber 35.

When the bit 6 is not pressed rearward from outside and the impact bolt 37 and the striker 34 in the tool holder 4 are positioned in the front portion of their operation ranges, the ventilation holes 36 are not blocked by the striker 34. Therefore, air in the air chamber 35 escapes from the ventilation holes 36 and the impact bolt 37 and the bit 6 make no reciprocal motion, preventing useless strikes. At this time, the small spring 46 and the spring 54 are in the compressed state.

When the bit 6 is pressed rearward by a reaction force from a workpiece or the like and the impact bolt 37 and the striker 34 are positioned in the rear portion of their operation ranges, on the other hand, the ventilation holes 36 are blocked by the striker 34. Thus, the striker 34 is pressed and drawn via air in the air chamber 35, and the impact bolt 37 and the bit 6 make reciprocal motion to cause a hammering action. FIG. 1B illustrates the bit 6 in the maximally pressed state.

In the case where the bit 6 is pressed rearward, the small spring 46 and the spring 54 are further compressed via the impact bolt 37, the ring 41, the rubber ring 42, and the slide sleeve 44 to cushion the pressing force through an elastic action. In the maximally pressed state, the front end of the cylinder 32 contacts the inner wall of the front-end portion of the slide sleeve 44 (the inner side of the ring-shaped portion).

In the case where the bit 6 is pressed rearward, the slide sleeve 44 is moved rearward to press the slide ring 52, which compresses the spring 54. In the case where the bit 6 is returned forward, meanwhile, the slide sleeve 44 and the slide ring 52 are returned forward by the action of the spring 54 etc. Such rearward movement and forward return is repeated for each strike, and the slide ring 52 contacts the washer 50 at each forward return. The washer 50 prevents the slide ring 52 from directly contacting the first circlip 48. This reduces the load on the first circlip 48 for fixation of the small spring 46, reducing the rate of progress of wear of the first circlip 48, the slide ring 52, and so forth. Since the washer 50 is made of a metal, the slide ring 52 can be firmly received with high strength. Since the washer 50 has been hardened through a heat treatment to provide higher hardness, the load on and the wear of the first circlip 48 etc. can be further reduced. A step is provided on the outer wall of the cylinder 32 on the rear side of the washer 50 (the inside portion of the rear surface of the washer 50). This allows the washer 50 to be supported by the step, further reducing the load on and the wear of the first circlip 48 etc.

Even if a pressing force, a striking stress, a reaction force against such forces, and so forth are cushioned by the small spring 46, the spring 54, the rubber ring 42, and so forth, a rearward force may be applied to the cylinder 32. Even if such a force is applied, the cylinder 32 can be received by the receiving portions A and B provided separately at the front and rear locations in the crank housing 22.

The flanges 40*f* and 40*g* of the sleeve member 40 which contact the front-end portion (thick portion) of the bevel gear 26 are held between the crank housing 22 and the barrel 60 to be fixed so as to be immovable in the front-rear direction. Thus, the bevel gear 26 is not displaced even if the tool holder 4 receives a forward force. This prevents a malfunction and wear of the bevel gear 26 and the intermediate shaft unit 25 due to displacement of meshing between the bevel gear 26 and the intermediate shaft unit 25.

When the crank housing 22 and members inside the crank housing 22 are assembled during manufacture of the hammer drill 1, the bevel gear 26, the sleeve member 40, and the spline ring 38 can be temporarily fixed at a desired position (at which they may be assembled correctly) in the crank housing 22 as described below. The sleeve member 40 is temporarily assembled in front of the front portion 26*a* of the bevel gear 26, the spline ring 38 with the slide plate 39 is temporarily assembled inside the arc portions 40*b*, 40*d*, 40*e*, and 40*e* (ring portion) of the sleeve member 40, and thus, the sleeve member 40 is loosely engaged with the bevel gear 26 and the spline ring 38. This facilitates correct assembly of the crank housing 22 etc., and allows simple and reliable manufacture, compared to a case where no temporary fixation is performed with no sleeve member 40 provided.

The function and the effect that may be achieved by the hammer drill 1 described above will be described.

The hammer drill 1 is provided with the crank housing 22 which accommodates the crankshaft 20, and the cylinder 32 accommodated in the crank housing 22. The receiving portions A and B which receive the cylinder 32 which is pressed rearward are provided at multiple locations of the crank housing 22 in the front-rear direction. Hence, the cylinder 32 which is pressed rearward by strikes etc. can be more reliably received compared to a case where the cylinder 32 is received only on the rear end surface. This allows the load to be carried by the receiving portions to be reduced through distribution, further improving the durability and extending the life by preventing occurrence of a crack or the like. At least one of the receiving portions (in the embodiment, the receiving portion B) can be disposed relatively freely in the crank housing 22. If the receiving portion B is disposed at the vertical wall of the front tubular portion which has relatively high rigidity, the cylinder 32 can be received even more reliably.

The receiving portion A is disposed so as to receive the rear-end portion of the cylinder 32. Thus, the receiving portion A is capable of receiving the entire cylinder 32 against a rearward action.

The portion of the cylinder 32, which is received by the receiving portion B, is the second circlip 58 (circumferential member) made of a metal. Thus, the cylinder 32 (second circlip 58) can be firmly received by the receiving portion B without being significantly deflected.

The crank housing 22 is made of a magnesium alloy. Therefore, the crank housing 22 can be made lightweight and highly rigid, allowing the cylinder 32 to be received further reliably.

The corner portion of the receiving portion A is rounded, and the corner portion of the cylinder 32 corresponding to the corner portion of the receiving portion A has the escape portion E provided apart from the corner portion of the receiving portion A. Therefore, concentration of a stress at the corner portion can be avoided. This allows the cylinder 32 to be received reliably, further improving the durability of the receiving portion A and extending the life of the receiving portion A.

The hammer drill 1 includes the crank housing 22 which accommodates the crankshaft 20, the tool holder 4 to which the bit 6 is mountable, the bevel gear 26 which rotates the tool holder 4, the sleeve member 40 disposed adjacent to the bevel gear 26, and the barrel 60 disposed adjacent to the crank housing 22. The sleeve member 40 is held between the crank housing 22 and the barrel 60 to be fixed in the axial direction of the tool holder 4.

Hence, movement of the bevel gear 26 in the front-rear direction can be reliably prevented by the sleeve member 40. This allows the bevel gear 26 and members around the bevel gear 26 to operate well, preventing wear of such components to extend the life thereof. The bevel gear 26 etc. can be temporarily retained in the crank housing 22 by the sleeve member 40, facilitating accurate assembly of the crank housing 22, the bevel gear 26, etc.

The sleeve member 40 includes the flanges 40*f* and 40*g* held between the crank housing 22 and the barrel 60, and the rear-end portion of the sleeve member 40 is provided adjacent to the front side of the front portion 26*a* of the bevel gear 26. Thus, movement of the bevel gear 26 in the front-rear direction can be suppressed appropriately in the case where the bevel gear 26 is disposed inside the front opening of the crank housing 22. Since the flanges 40*f* and 40*g* are formed at the front-end portion of the sleeve member 40, the bevel gear 26 etc. can be temporarily retained appropriately.

The sleeve member 40 is formed by pressing. Thus, the sleeve member 40 can be imparted with high hardness, appropriately suppressing movement of the bevel gear 26 in the front-rear direction by preventing elastic deformation of the sleeve member 40 itself.

The sleeve member 40 includes the small projection 40*h* and the projection 40*i*, and the crank housing 22 is provided with the recessed portions which receive the small projection 40*h* and the projection 40*i*, respectively. Therefore, the sleeve member 40 is prevented from contacting the bevel gear 26 or the spline ring 38 by some chance to rotate together with the bevel gear 26 and the spline ring 38, securing accurate operation even if the sleeve member 40 is provided.

The hammer drill 1 further includes the spline ring 38 which is engageable with the bevel gear 26, and the outside diameter of the spline ring 38 is substantially the same as the inside diameter of the sleeve member 40. Thus, the spline ring 38 configured to switch whether or not to rotate the tool holder 4 (whether or not to perform drill operation) can operate even if the sleeve member 40 is provided, allowing the spline ring 38 and the bevel gear 26 to be temporarily assembled appropriately.

The spline ring 38 includes the groove 38*b* provided circumferentially. The groove 38*b* is engaged with the hooks 39*a* and 39*a* of the slide plate 39 which moves in the front-rear direction to switchably establish and release engagement of the spline ring 38 with the bevel gear 26. The sleeve member 40 is provided with the notched portion 40*a* to avoid the slide plate 39. Therefore, the spline ring 38 can be engaged with and disengaged from the bevel gear 26 further smoothly by the slide plate 39 even if the sleeve member 40 is provided.

The present invention is not limited to the embodiment described above, and may be modified as appropriate as follows, for example.

Three or more receiving portions may be provided at locations that are separated from each other in the front-rear direction. The escape portion provided at the rear end of the cylinder may be omitted. An escape portion for the receiving portion may be provided at the corner of the received portion (circlip) at the center of the cylinder. An escape portion may be provided at portions of the cylinder which are received by both (or all) of the receiving portions. The receiving portion corresponding to the rear end of the cylinder may not be provided, and a receiving portion that receives a circlip or the like may instead be provided at another location that is separate in the front-rear direction. Various materials may be used. In particular, the material of the crank housing may be a material other than a magnesium alloy, or a combination of a plurality of materials. The corner of the cylinder at the escape portion may be rounded. The corner of the receiving portion may be filled so as to be in a chamfered state. The crank may use a swash plate or the like in place of the crank projection and the rod configured to convert rotational motion into reciprocal motion.

The sleeve member, the barrel, and the crank housing may be an assembly of a plurality of portions. The number of the flanges and the notched portions of the sleeve member, the (small) projections, and the hooks of the slide plate may be one or three or more. The (small) projections may be longer (shorter), or may be substantially the same in size as each other. The number of the teeth of the bevel gear and the spline ring may be increased or decreased. The rear portion of the bevel gear may have the same size as the front portion, rather than being reduced in diameter with respect to the front portion. The sleeve member may be formed by a method other than pressing. Besides, the number, the arrangement, the presence or absence, etc. of various members may be modified as appropriate. The embodiment and the modifications described above may be applied to other impact tools including an electric hammer and other types of hammer drills.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. An impact tool comprising:

a crank housing that accommodates a crank; and a cylinder accommodated in the crank housing, wherein:

receiving portions that receive the cylinder which is pressed rearward are provided at multiple locations of the crank housing in a front-rear direction, at least one portion, among portions of the cylinder which are received by the receiving portions, is a circlip made of a metal, and the circlip physically contacts both an outer surface of the cylinder and an inner surface of the crank housing.

2. The impact tool according to claim 1, wherein at least one of the receiving portions is disposed so as to receive a rear-end portion of the cylinder.

3. The impact tool according to claim 1, wherein the crank housing is made of a magnesium alloy.

4. An impact tool comprising:

a crank housing that accommodates a crank; and a cylinder accommodated in the crank housing, wherein:

receiving portions that receive the cylinder which is pressed rearward are provided at multiple locations of the crank housing in a front-rear direction, a corner portion of at least one receiving portion among the receiving portions is rounded, and a corner portion of the cylinder corresponding to the corner portion of the at least one receiving portion has an escape portion provided apart from the corner portion of the at least one receiving portion.

5. An impact tool comprising:

a crank housing that accommodates a crank;

a cylinder accommodated in the crank housing, wherein receiving portions that receive the cylinder which is pressed rearward are provided at multiple locations of the crank housing in a front-rear direction;

a tool holder to which a bit is mountable;

a bevel gear that rotates the tool holder;

a sleeve member disposed adjacent to the bevel gear; and a barrel disposed adjacent to the crank housing, wherein:

the sleeve member is held between the crank housing and the barrel to be fixed in an axial direction of the tool holder, the sleeve member includes a projection, and the crank housing is provided with a recessed portion that receives the projection.

6. The impact tool according to claim 5, wherein the sleeve member includes a flange held between the crank housing and the barrel, and a rear-end portion of the sleeve member is provided adjacent to a front side of the bevel gear.

7. The impact tool according to claim 5, wherein the sleeve member is formed by pressing.

8. The impact tool according to claim 5, further comprising:

a cam member that is engageable with the bevel gear, wherein an outside diameter of the cam member is substantially the same as an inside diameter of the sleeve member.

9. The impact tool according to claim 8, wherein the cam member includes a groove provided circumferentially, the groove is engaged with a slide plate that switchably establishes and releases engagement of the cam member with the bevel gear, and the sleeve member is provided with a notched portion to avoid the slide plate.

* * * * *